US007081016B2

(12) United States Patent
Tateno

(10) Patent No.: US 7,081,016 B2
(45) Date of Patent: Jul. 25, 2006

(54) MULTIPOLE HIGH-FREQUENCY COAXIAL CONNECTOR

(75) Inventor: Kouichi Tateno, Tokyo (JP)

(73) Assignee: Clarion Co., Ltd., Tokyo (JP)

( * ) Notice: Subject to any disclaimer, the term of this patent is extended or adjusted under 35 U.S.C. 154(b) by 18 days.

(21) Appl. No.: 10/938,675

(22) Filed: Sep. 13, 2004

(65) Prior Publication Data

US 2005/0070158 A1 Mar. 31, 2005

(30) Foreign Application Priority Data

Sep. 29, 2003 (JP) ..... P2003-337538

(51) Int. Cl.
*H01R 13/40* (2006.01)

(52) U.S. Cl. ..... 439/585; 439/825

(58) Field of Classification Search ..... 439/578, 439/585 I, 825 X, 866, 867
See application file for complete search history.

(56) References Cited

U.S. PATENT DOCUMENTS

| | | | | |
|---|---|---|---|---|
| 5,911,599 | A * | 6/1999 | Masuda | 439/610 |
| 5,913,694 | A * | 6/1999 | Wright | 439/394 |
| 6,203,372 | B1 * | 3/2001 | Matsumoto et al. | 439/607 |
| 6,210,223 | B1 * | 4/2001 | Aoyama et al. | 439/585 |
| 6,447,334 | B1 * | 9/2002 | Togashi et al. | 439/578 |
| 6,749,464 | B1 * | 6/2004 | Obata | 439/610 |
| 6,753,475 | B1 * | 6/2004 | Takahashi et al. | 174/75 C |
| 6,808,417 | B1 * | 10/2004 | Yoshida | 439/585 |

FOREIGN PATENT DOCUMENTS

| | | |
|---|---|---|
| EP | 0 414 495 A1 | 2/1991 |
| FR | 1 582 933 | 10/1969 |
| JP | 11-74037 | 3/1999 |

OTHER PUBLICATIONS

European Search Report dated Feb. 4, 2005.

* cited by examiner

*Primary Examiner*—Thanh-Tam Le
(74) *Attorney, Agent, or Firm*—McGinn IP Law Group, PLLC

(57) ABSTRACT

A high-frequency coaxial connector, including male connector portions and female connector portions. Each connector portion includes a grounding terminal. When connector portions are mated, each male connector portion grounding terminal is within the grounding terminal of an associated female connector portion. The grounding terminal of each male connector portion has a radially protruding section at its distal end. The distal end of at least one grounding terminal of each mateable associated male connector portion and female connector portion has slits therein, permitting the radially protruding sections of the male connector portion grounding terminals to alter the diameter of the distal ends of the slitted grounding terminals as the male connector portion grounding terminals are inserted into the female connector portion grounding terminals during mating of connector portions, assuring contact between the grounding terminals of the mated connector portions so as to provide electrical continuity between the grounding terminals.

6 Claims, 5 Drawing Sheets

MULTIPOLE HIGH-FREQUENCY COAXIAL CONNECTOR

BACKGROUND OF THE INVENTION

1. Field of the Invention

The present invention relates to a multipole high-frequency coaxial connector mainly suitable for connection to an antenna.

2. Description of the Related Art

Concerning high-frequency connectors, 1.5 GHz band-compatible connectors for coaxial cables are conventionally known as connectors for AM/FM band frequencies and television band frequencies. As their types, unipole (1-pin) connectors and multipole (multi-pin) connectors such as the one shown in a related art patent document are known.

In digital communication which will become widespread in the future, a frequency band of 3 GHz to 4 GHz which is higher than ordinary AM/FM analog radio or television frequency bands is used. This applies not only to consumer communications equipment but also to vehicle-mounted antennas. For example, satellite antennas, mobile telephone antennas, and GPS antennas are also used at the high-frequency band of 3 GHz to 4 GHz.

In the connection of such a digital antenna, a connector compatible with a high frequency band is indispensable. Moreover, a satellite antenna requires two-pole outputs of a ground wave and a satellite wave, and a mobile telephone antenna requires two-pole outputs of personal mobile communication and a digital cellular or analog cellular telephone system. However, it has been impossible for the related art technique to be used in a compatible manner.

As a countermeasure for this problem, as shown in FIG. 10, coaxial cables connected to each antenna are respectively connected to 1-pin type unipole connectors C and D, which are in turn connected to an unillustrated pair of unipole connectors. However, there have been problems in that a wiring of the system becomes complex, that a connection operation involves time and trouble, and that a cost becomes high.

SUMMARY OF THE INVENTION

The present invention has been devised to overcome the above-described problems, and its object is to provide a multipole and compact high-frequency coaxial connector which is suitable as a coaxial connector for interfacing a high-frequency antenna system of 3 GHz to 4 GHz, such as a satellite antenna, a mobile telephone antenna and an ETC (electronic toll collection) antenna.

To attain the above-described object, the multipole high-frequency coaxial connector in accordance with the invention includes: a male section and a female section that connect a plurality of coaxial cables concurrently; and a housing made of synthetic resin that is provided in the male section and the female section respectively, wherein each coaxial cable is provided with a coaxial cable terminal respectively on one end thereof that is inserted parallel in the housing, each coaxial cable terminal includes: a hot terminal fixed to cover a central conductor projecting from each coaxial cable; a tubular insulator fixed to cover the hot terminal; and a grounding terminal that is provided on an outer periphery of the insulator and connected to a terminal fixed to an outer conductor of each coaxial cable, and the grounding terminals of each coaxial cable of the male section and the female section are configured to be engaged with each other in a case where the male section and the female section are engaged with each other.

In a high-frequency connector for a frequency band of 3 GHz to 4 GHz, a multipole connector can be realized with a relatively simple single housing structure. For instance, in a case of satellite use, two-pole outputs of a ground wave and a satellite wave can be realized, and in a case of mobile telephone use, two-pole outputs of personal mobile communication and a digital cellular or analog cellular telephone system can be realized. Furthermore, 3-pole outputs of GPS, ETC, and VICS can be realized. Thus it is possible to obtain an outstanding advantage in that a plurality of high-frequency interfaces in digital-compatible high-frequency antenna signal communication, which will become widespread in the future, can be configured by a single connector.

Moreover, as compared with a case where a plurality of unipole coaxial connectors is used, the housing can be used in common. Further, since the tubular insulator is fitted over the hot terminal, and the grounding terminal is fitted over it, protection can be provided against signal interference between the terminals in the parallel state. Since the distance between adjacent ones of the terminals can be made short, the size of the connector can be made compact. Furthermore, in terms of use, an advantage can be obtained in that the connecting operation of the connector on the vehicle side is facilitated, making it possible to reduce the operating time.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
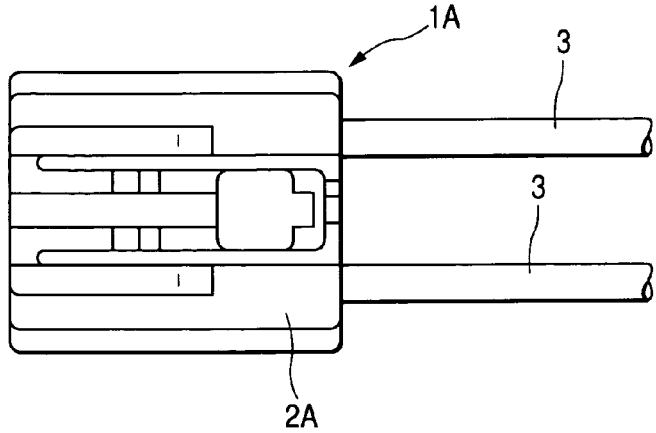
FIG. 1 is a plan view illustrating a female section of a multipole high-frequency coaxial connector in accordance with an embodiment of the invention.
Figure 2:
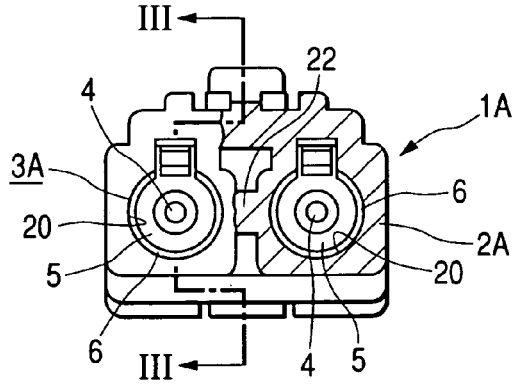
FIG. 2 is a front elevational view, partially in cross-section, of the female section.

The grounding terminals of the male section and the female section are formed of plates of a circular cross section, and one of the grounding terminals has a plurality of slits in a circumference thereof.

According to this construction, although a plurality of poles are provided, the size of the connector housing can be made compact, and contact at the time of engagement can be made satisfactory.

[First Embodiment]

Referring now to the accompanying drawings, a description will be given of an embodiment of the invention.

FIGS. 1 to 9 illustrate an embodiment of a high-frequency coaxial connector in accordance with the invention, in which reference character 1A denotes a female section, and 1B denotes a male section.

Reference character 2A denotes a synthetic resin-made housing for the female section 1A, and 2B denotes a synthetic resin-made housing for the male section 1B.

Reference numeral 3 denotes one of a plurality of (in this embodiment, two) coaxial cables for a frequency band of 3 GHz to 4 GHz. In this coaxial cable 3, a central conductor (core) 30 is enclosed with an insulating/cushioning 31 such as polyethylene, a braided outer conductor (shield) 32 is provided around its outer periphery, and a resin cladding 33 is further provided on its outer side. Terminations of the coaxial cables 3 are respectively inserted in the housings 2A and 2B in a parallel state.

Special connection parts 3A and 3B, in which a hot terminal, an insulator, and a grounding terminal are combined, are provided at the terminations of the coaxial cables 3, as shown in FIGS. 3, 7A, 7B, 6, and 8.

[Concerning Connection Part 3A of Female Section-Side Coaxial Cable 3]

Figure 3:
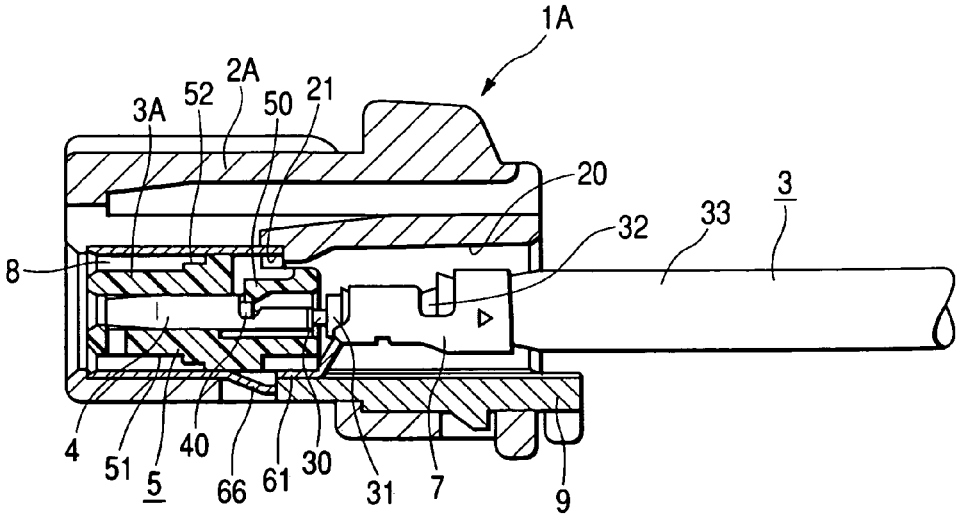
FIG. 3 is a cross-sectional view taken along line III—III in FIG. 2.
Figure 4:
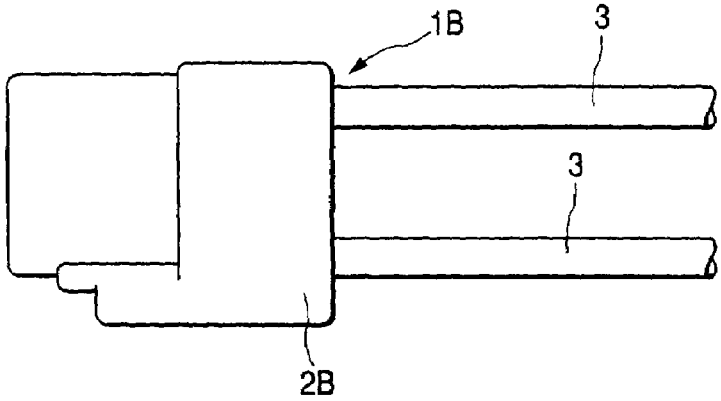
FIG. 4 is a plan view illustrating a male section of the multipole high-frequency coaxial connector in accordance with the embodiment of the invention.
Figure 5:
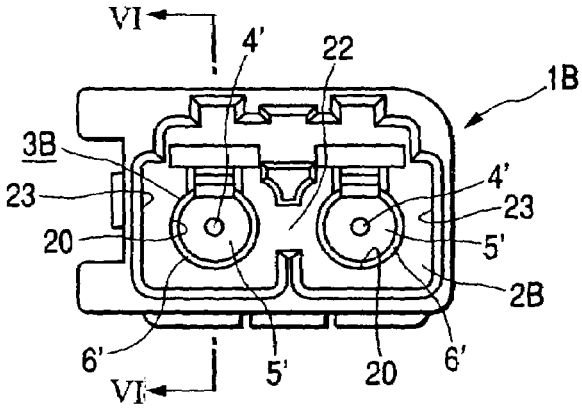
FIG. 5 is a front elevational view of the male section.

To describe the connection part 3A of the coaxial cable 3 of the female section 1A, a hot terminal 4 is fitted over and secured to the central conductor 30 projecting from the termination of each coaxial cable 3. The hot terminal 4 is closely fitted and inserted in a synthetic resin-made insulator 5 which is tubular as a whole. As shown in FIG. 3, the hot terminal 4 has a recessed portion 40 at its intermediate portion, and a three-way cut resiliently engaging piece 50 formed in the insulator 5 is engaged therewith to obtain positioning and fixation.

A hollow cylindrical grounding terminal 6 made of aluminum or the like is fitted over and fixed to the insulator 5. A reduced-diameter portion 51 is formed on an outer periphery of a front half portion of the insulator 5 so as to form an annular gap 8 with respect to an inner periphery of the front portion of the grounding terminal for the entry of the male section-side grounding terminal.

Figure 7A:
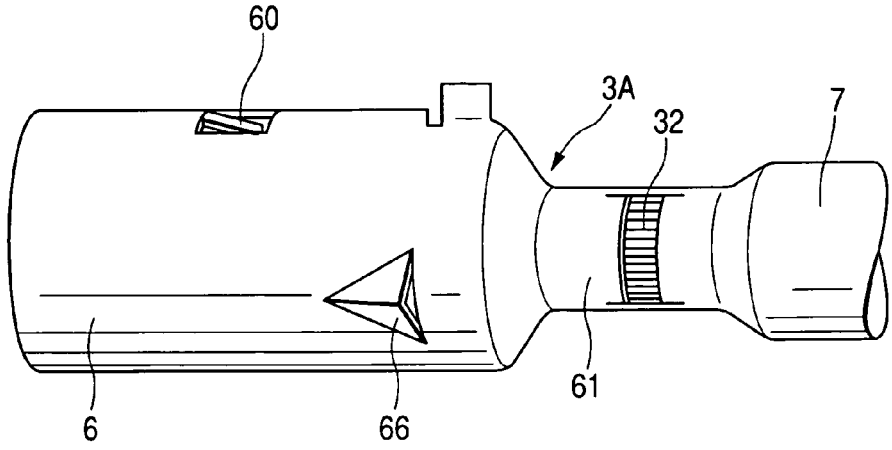
FIG. 7A is an enlarged perspective view of a connection part of the female section.

As shown in FIG. 7A, a three-way cut resiliently engaging piece 60 is formed in a portion of the grounding terminal 6, and is engaged with a stepped portion 52 of the insulator 5 to obtain positioning and fixation.

The grounding terminal 6 has an axially extending portion 61 formed continuously on a portion of its circumference, and a crimping terminal portion 7 is formed at an end of the axially extending portion 61. The crimping terminal portion 7 is crimped by surrounding the outer conductor 32 of the coaxial cable 3.

[Concerning Connection Part 3B of Male Section-Side Coaxial Cable 3]

To describe the connection part 3B of the coaxial cable 3 of the male section 1B, a hot terminal 4' to be inserted into a hole of the female section-side hot terminal 4 is fitted over and secured to the central conductor 30 projecting from the termination of the coaxial cable 3. Further, the hot terminal 4' is closely fitted and inserted in a synthetic resin-made insulator 5' which is cylindrical as a whole. The hot terminal 4' has the recessed portion 40 at its intermediate portion, and the three-way cut resiliently engaging piece 50 formed in the insulator 5' is engaged therewith to obtain positioning and fixation.

A cylindrical grounding terminal 6' is fitted over and fixed to the insulator 5'. This grounding terminal 6' has a smaller outside diameter than the grounding terminal 6 on the female section side. A plurality of slits 64 are provided in the circumference of the grounding terminal 6' over a predetermined range from its distal end, and a radially protruding potion 65 is provided in the vicinity of the distal end.

A distal end face of the insulator 5' is located in the rear of the slits 64 so as to abut against or to be in close proximity to a distal end face of the mating insulator 5 when the grounding terminals 6 an 6' are engaged with each other.

The grounding terminal 6' has the axially extending portion 61 formed continuously on a portion of its circumference, and the crimping terminal portion 7 is formed at an end of the axially extending portion 61. The crimping terminal portion 7 is crimped by surrounding the outer conductor 32 of the coaxial cable 3.

Figure 7B:
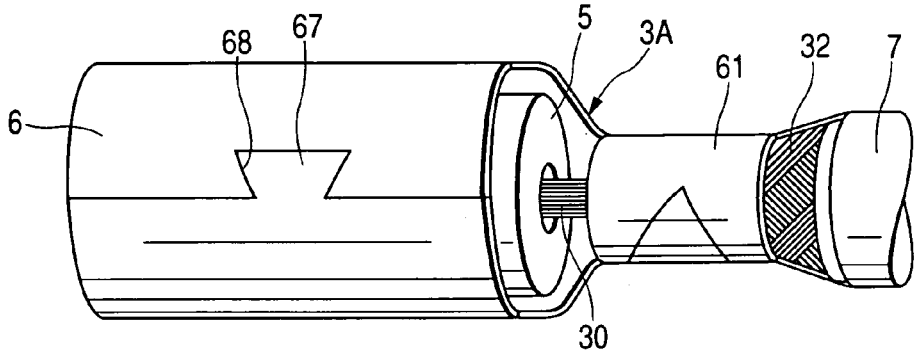
FIG. 7B is an enlarged perspective view of the connection part of the female section in a position in which it is rotated 90°.
Figure 8:
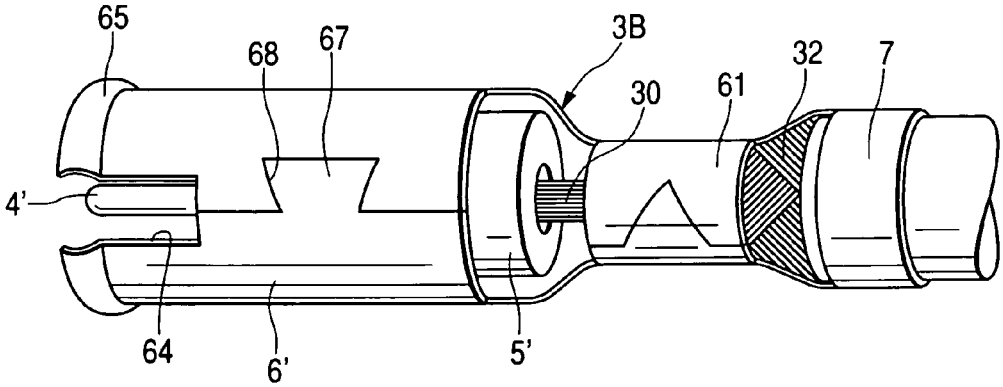
FIG. 8 is an enlarged perspective view of a connection part of the male section.

It should be noted that the grounding terminals 6 and 6' including the crimping terminal portions 7 are formed of a plate material. The grounding terminals 6 and 6' are each formed such that the plate is wrapped around each of the insulators 5 and 5', and in this state its circumferential ends are soldered together, or coupled by fitting together a projection 67 and a recessed portion 68 which are dovetail-shaped, as shown in FIG. 7B. The male-side grounding terminal 6' is provided in advance with the slits at predetermined intervals in its distal region in the state of the plate.

The pair of connection parts 3A of the coaxial cables 3 in the female section 1A are respectively inserted in a pair of parallel through hole portions 20 of a substantially circular cross section formed in the housing 2A, such that the respective grounding terminal 6 reaches the vicinity of the opening in the housing 2A. The through hole portions 20 are not limited to the case in which their cross sections have closed contours.

Further, as shown in FIG. 3, a rear end face of a main portion of each grounding terminal 6 abuts against an end 21 in the housing 2A, and a fixing bar 9 inserted in the housing abuts against a bulging projection 66 formed on a portion of the circumference of the grounding terminal 6, thereby fixing the respective grounding terminal 6 in the housing 2A.

The housing 2A is provided with a partition wall 22 to form the pair of through hole portions 20 of the respective connection parts 3A.

Figure 6:
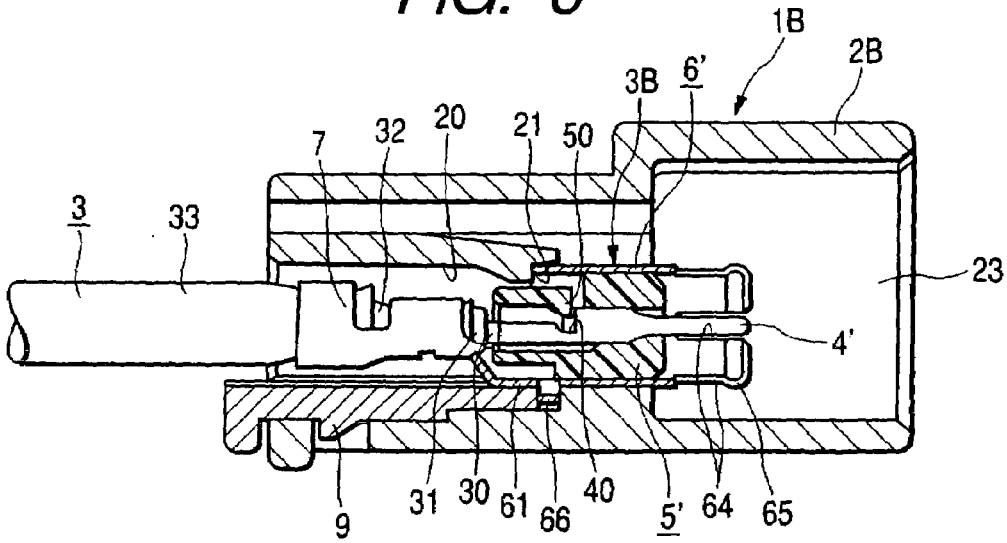
FIG. 6 is a cross-sectional view taken along line VI—VI in FIG. 5.

In addition, as shown in FIG. 6, the housing 2B has a pair of fitting cavities 23 for the housing 2A in such a manner as to extend over a predetermined range from its opening.

The pair of parallel through hole portions 20 of the substantially circular cross section is provided continuing from the respective fitting cavities 23. The pair of grounding terminals 6' are respectively inserted in these through hole portions 20 such that the slits 64 in their distal regions are located in the respective fitting cavities 23.

Further, as shown in FIG. 6, a rear end face of the main portion of each grounding terminal 6' abuts against the end portion 21 in the housing 2B, and the fixing bar 9 inserted in the housing abuts against the bulging projection 66 formed on a portion of the circumference of the grounding terminal 6', thereby fixing the respective grounding terminal 6' in the housing 2B.

The housing 2B is provided with the partition wall 22 to form the pair of through hole portions 20 of the respective connection parts 3B.

It should be noted that the invention is not limited to the embodiment. For instance, the following arrangements may alternatively be adopted.

1) Although a 2-pole connector is adopted in the embodiment by using two coaxial cables, 3-pole, 4-pole, or other connectors may be adopted by using 3, 4, or other number of coaxial cables.
2) The slits 64 may be provided in the grounding terminal 6, and the grounding terminal 6' may be formed in a tubular shape.

Figure 9:
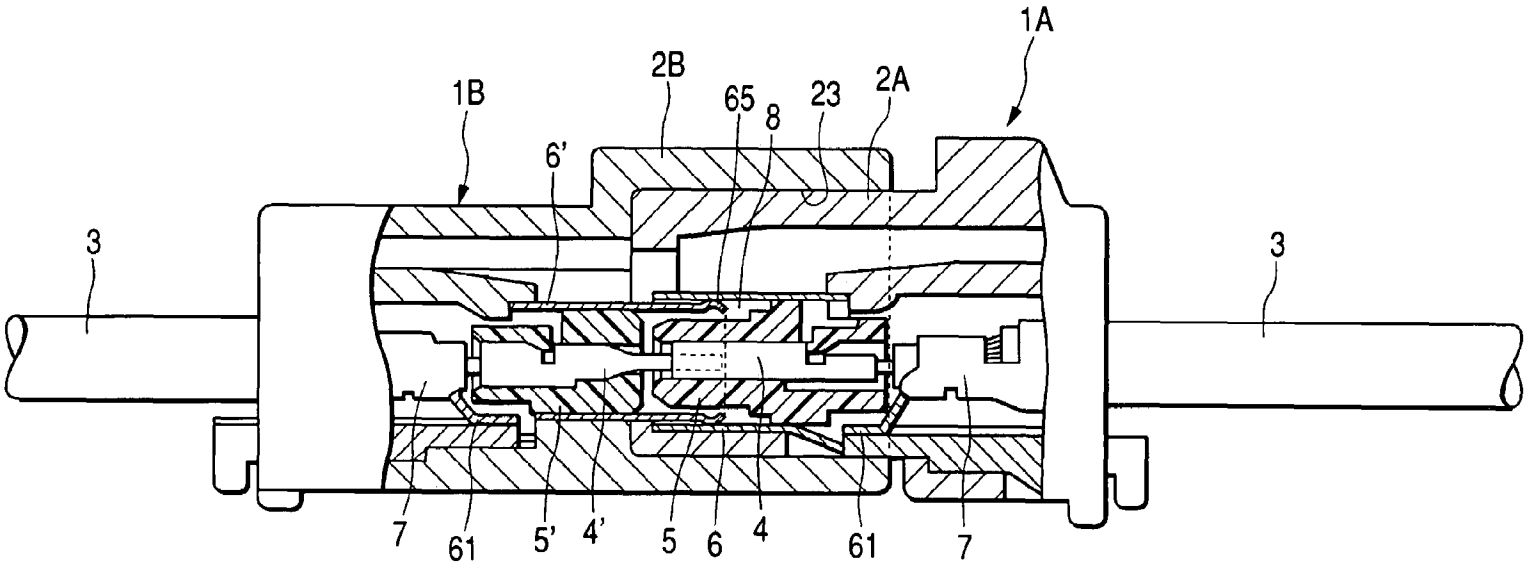
FIG. 9 is a cross-sectional view of a connected state.
Figure 10:
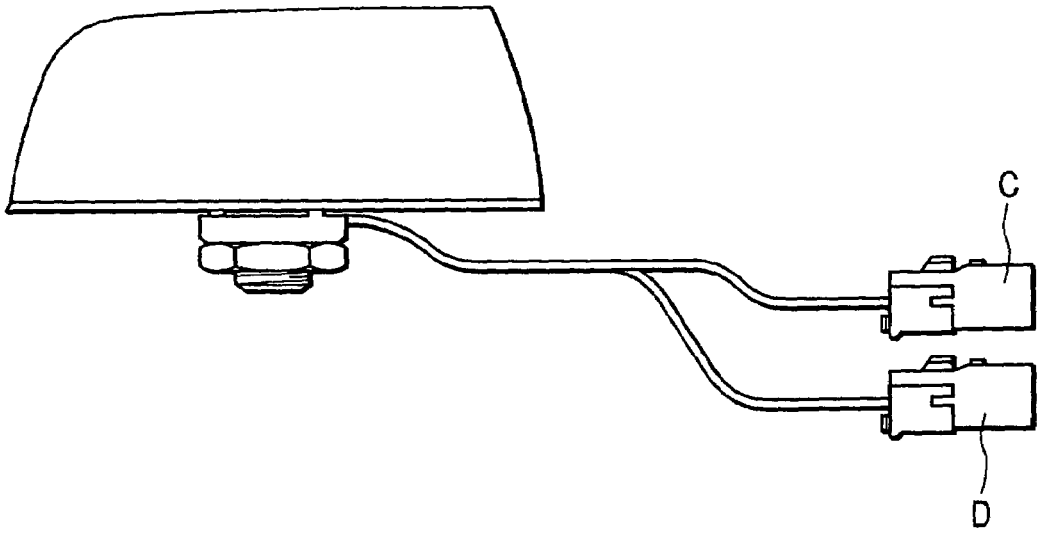
FIG. 10 (BACKGROUND ART)
FIG. 10 is an explanatory diagram illustrating a signal system of a conventional vehicle-mounted antenna.

In the invention, the female sections 1A or the male sections 1B are connected to coaxial cables from the antenna, the male sections 1B or the female sections 1A are connected to coaxial cables on an apparatus side, and the housings 2A and 2B are engaged with each other. As a result, the plurality of sets of connection parts 3A and 3B which are in a parallel relationship in the housings 2A and 2B are respectively connected, as shown in FIG. 9, and simultaneous connection of 2 or more poles can be obtained. Accordingly, the connecting operation can be performed only once, and the arrangement is made simple as compared with the case where the unipole connectors are connected one by one.

When the housing 2A of the female section 1A is engaged in the fitting cavities of the male section 1B, each grounding terminal 6' of the male section 1B enters the annular gap 8 in the female section 1A. However, since the slits 64 are provided, the grounding terminal 6' is fitted in the grounding terminal 6 in the female section 1A while undergoing a reduction in its diameter, and the radially protruding potion 65 is brought into close contact due to the enlargement of its diameter caused by restoration. Accordingly, the state of connection is reliable, and an appropriate grounding can be obtained.

At the same time, since the insulator 5 of the female section 1A and the insulator 5' of the male section 1B are substantially abutted against each other inside each of the grounding terminals 6 and 6', reliable insulation is provided. In this state, the hot terminal 4' of the male section 1B is inserted in the hot terminal 4 of the female section 1A inside the grounding terminals 6 and 6'. Accordingly, it is possible to reliably receive or transmit a high-frequency signal.

If high-frequency signal systems are located in close proximity to each other, mutual interference can be induced, thereby frequently resulting in an antenna signal performance loss. For this reason, the higher the frequency, the more it is necessary to space apart the distance between adjacent ones of the multipole terminals inside the connector. In that case, the size of the connector itself becomes large, and it becomes difficult to render the multipole connector compact.

Therefore, in the invention, the insulators 5 and 5' are provided in the grounding terminals 6 and 6' of the connection parts 3A and 3B which are in the parallel relationship, thereby providing protection from signal interference between the hot terminals 4 and 4' which are in the parallel relationship. For this reason, the housing can be made compact by making the terminal pitch small.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A multipole high-frequency coaxial connector, comprising a first housing; a plurality of male connector portions within said first housing, each male connector portion configured to receive a respective coaxial cable; a second housing; and a like plurality of female connector portions within said second housing, each female connector portion configured to receive a respective coaxial cable, wherein:

each connector portion comprises:

a hot terminal configured to contact a central conductor of the respective coaxial cable;

a tubular insulator covering a part of the hot terminal; and a grounding terminal provided on an outer periphery of the insulator and configured to be connected to a second conductor of the respective coaxial cable, said first housing and said second housing are configured to be engaged to mate said connector portions, with each male connector portion hot terminal within the hot terminal of an associated female connector portion, and with each male connector portion grounding terminal within the grounding terminal of said associated female connector portion, the grounding terminal of each male connector portion has a radially protruding section at a distal end thereof, and the distal end of at least one grounding terminal of each mateable associated male connector portion and female connector portion has a plurality of slits therein, permitting the radially protruding sections of said male connector portion grounding terminals to alter a diameter of the distal ends of the slitted grounding terminals as the male connector portion grounding terminals are inserted into said female connector portion grounding terminals during mating of said connector portions, assuring contact between the grounding terminals of the mated connector portions so as to provide electrical continuity between said grounding terminals.

2. The multipole high-frequency coaxial connector according to claim 1, wherein each grounding terminal is formed of a plate having a circular cross section.

3. The multipole high-frequency coaxial connector according to claim 1, wherein said housings are made of synthetic resin.

4. A high-frequency coaxial connector, comprising a first housing; a male connector portion within said first housing and configured to receive a first coaxial cable; a second housing; and a female connector portion within said second housing and configured to receive a second coaxial cable, wherein:

each connector portion comprises:

a hot terminal configured to contact a central conductor of the associated coaxial cable;

a tubular insulator covering a part of said hot terminal; and a grounding terminal provided on an outer periphery of said insulator and configured to be connected to a second conductor of said associated coaxial cable;

said first housing and said second housing are configured to be engaged to mate said connector portions, with said male connector portion hot terminal within said female connector portion hot terminal, and with said male connector portion grounding terminal within said female connector portion grounding terminal, the grounding terminal of said male connector portion has a radially protruding section at a distal end thereof, and the distal end of at least one of said grounding terminals has a plurality of slits therein, permitting the radially protruding section of said male connector portion grounding terminal to alter a diameter of the distal end of said at least one of said grounding terminals as said male connector portion grounding terminal is inserted into said female connector portion grounding terminal during mating of said connector portions, assuring contact between the grounding terminals of the mated connector portions so as to provide electrical continuity between said grounding terminals.

5. The multipole high-frequency coaxial connector according to claim 4, wherein each grounding terminal is formed of a plate having a circular cross section.

6. The multipole high-frequency coaxial connector according to claim 4, wherein said housings are made of synthetic resin.

* * * * *